US006292965B1

(12) United States Patent
Gambrell

(10) Patent No.: US 6,292,965 B1
(45) Date of Patent: Sep. 25, 2001

(54) MATTRESS

(76) Inventor: Dwain P Gambrell, 102 Mason Croft, Sumter, SC (US) 29150

( * ) Notice: Subject to any disclaimer, the term of this patent is extended or adjusted under 35 U.S.C. 154(b) by 0 days.

(21) Appl. No.: 09/680,114

(22) Filed: Oct. 5, 2000

(51) Int. Cl.[7] ..... A47C 25/00
(52) U.S. Cl. ..... 5/716; 5/721; 5/727
(58) Field of Search ..... 5/716, 717, 720, 5/721, 737, 727

(56) References Cited

U.S. PATENT DOCUMENTS 2,558,166 * 6/1951 Barnes ..... 5/727
3,626,523 * 12/1971 Robins ..... 5/727
5,027,459 * 7/1991 Perry, Jr. et al. ..... 5/716
5,649,332 7/1997 Wells et al. .
5,953,778 * 9/1999 Hiatt ..... 5/716
5,957,438 * 9/1999 Workman et al. ..... 5/720

* cited by examiner

*Primary Examiner*—Michael F. Trettel
(74) *Attorney, Agent, or Firm*—Michael A Mann; Nexsen Pruet Jacobs & Pollard LLC

(57) ABSTRACT

A mattress with two bands running across its faces to increase firmness and body weight distribution. These bands are composed of panels of a highly resilient material fastened to panels of non-resilient material. The resilient panels are positioned where the greatest load concentrations are likely to be when the mattress is in use. The resilient panels are oriented to stretch in a direction parallel to the major dimension of the band and, as they are stretched, increase in tension in proportion to the load. The greater the load, the greater the tension on the resilient panels and the firmer the mattress becomes in response to the load.

20 Claims, 4 Drawing Sheets

MATTRESS

FIELD OF THE INVENTION

The present invention relates generally to mattresses, and in particular to coil spring mattresses.

BACKGROUND OF THE INVENTION

There are a variety of mattress types, distinguished in general by their construction. One particular type of mattress construction is generally referred to as a spring mattress. This type has a two dimensional matrix of resilient metal coils bound within a metal frame and covered with a pallet composed of several layers of materials. The coils resist compression, such as occurs when weight is applied to them, and thus could provide a firmer sleeping surface than other mattress construction types, if desired, such as foam mattresses.

A number of improvements have been made to the spring mattress, including varying the compressive strength of the individual coils in the matrix so that those which are likely to bear the greatest compressive loads have the most compressive strength. Springs with greater spring force are placed in that matrix where the load is expected to be greater, based on generalized assumptions about the load.

The material coverings that form the pallet have also improved. A spring mattress coil array could typically be covered by a thin mesh material to isolate the coils from the layers of materials above it. A thin fiber layer covers the mesh layer and then a thicker layer of foam is applied on top of the fiber layer. Finally, the mattress is finished with a quilted textile layer. The textile layer is bound to the balance of the mattress using a side wrap that covers the sides of the coil array and is sewn to quilted top and bottom panels.

Human beings spend one third of their lives in bed. Sleep is a vital part of human activity and essential for good health. It is believed that a mattress with support and good weight distribution provides a more restful sleep than one that is too soft and sinks in the middle. Therefore, mattress construction that improves comfortable firmness and weight distribution is a continuing objective of those who design mattresses.

SUMMARY OF THE INVENTION

According to its major aspects and briefly stated, the present invention is a mattress with an added layer to increase desired firmness and to help with body weight distribution. In addition to other layers that may commonly be found in modern spring mattress construction, the present invention includes, preferably, two bands running across the approximate mid-section of a mattress's spring assembly. These bands include panels of a highly resilient material fastened to non-resilient panels. The resilient panels are positioned where the greatest load concentrations are likely to be when the mattress is in use. The resilient panels are oriented to stretch in a direction parallel to the major dimension of the band and, as they are stretched, increase in tension in proportion to the weight of the load. The greater the load, the greater the tension on the resilient panels. The result is a mattress with greater firmness when and where needed and proportional to the load applied, as in body weight distribution.

An important feature of the present invention is the use of strategically placed panels of highly resilient material. These panels, in addition to cooperating with the coils springs in resisting the downward force of a load, increase in their resistance to the amount of the applied load. Thus, the panels, strategically placed, augment the springs where most needed to increase firmness. The present invention can be used with a matrix of uniform coils.

Another feature of the present invention is the combination of resilient panels with non-resilient panels elsewhere in the bands. This combination allows strategic placement of panels for a localized benefit but makes the attachment of the resilient panels together to make the bands a simple matter. The present bands are constructed of resilient and non-resilient panels in the sequence and size desired and can then simply be attached to the sides (or ends) of the coil spring system so that the resilient panels are located where needed. The number, width and height of the various panels can be selected based on the size of mattress and anticipated location of the load.

Other features and their advantages will be apparent to those skilled in the art of mattress construction from a careful reading of the Detailed Description of Preferred Embodiments, accompanied by the drawings.

BRIEF DESCRIPTION OF THE DRAWINGS

In the Figures.

DETAILED DESCRIPTION OF PREFERRED EMBODIMENTS

Figure 1:
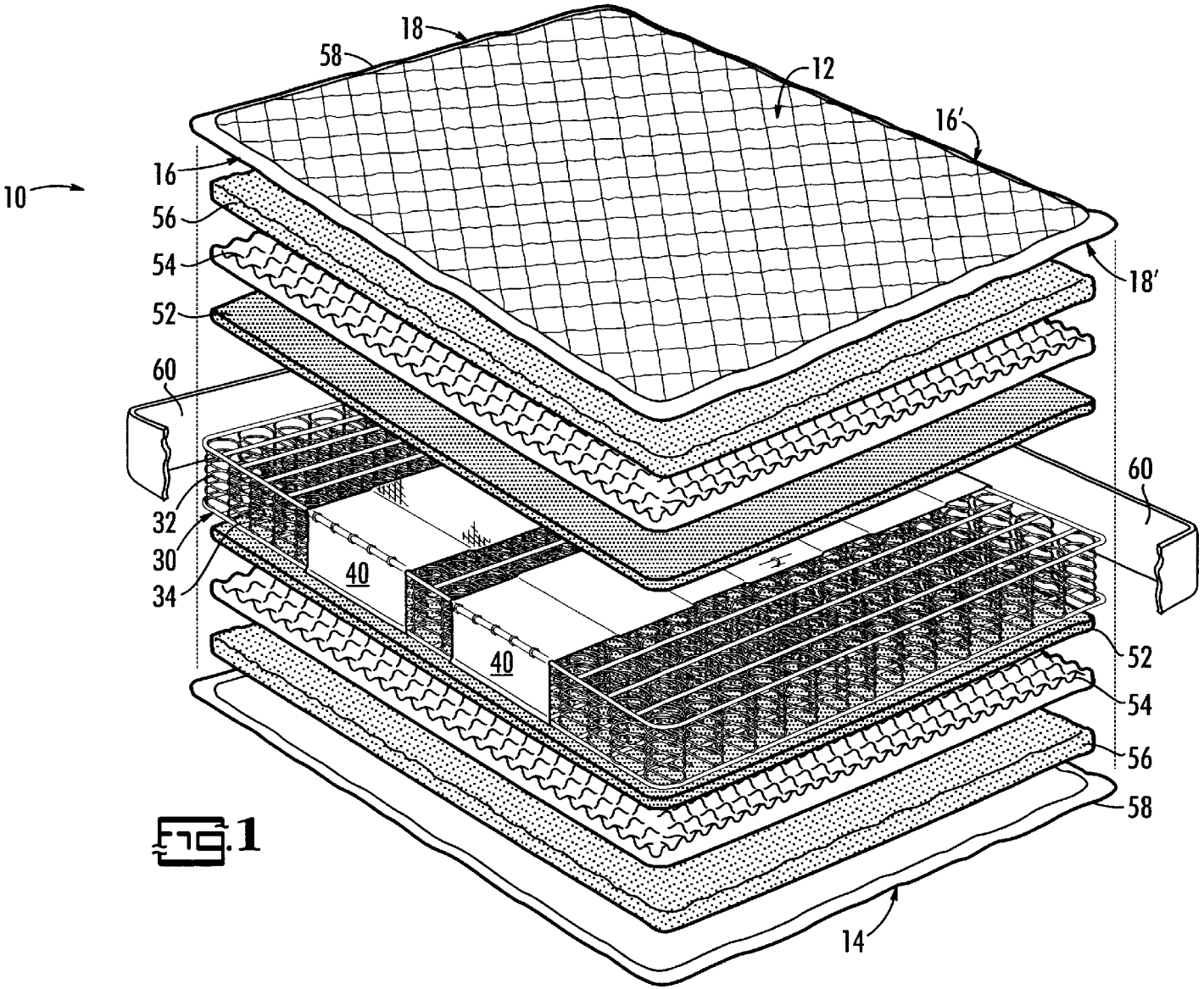
FIG. 1 is a perspective, exploded view of a mattress, according to a preferred embodiment of the present invention.

The present invention is a mattress with improved firmness and body weight distribution. FIG. 1 illustrates a mattress, generally indicated by reference numeral 10, in an exploded view to reveal various layers that comprise mattress 10. Mattress 10 has a top face 12, a bottom face 14, two sides 16, 16', and two ends 18, 18'. Inside mattress 10 is a spring assembly 30 composed of a matrix of coiled springs 32. Springs 14 are confined within and bound to a frame 34.

On top and on the bottom of spring assembly 30 are bands 40. There is preferably at least one band, most preferably at least two bands, and which preferably run from side 16 to side 16'.

Next follows a layered sequence that collectively forms a pallet 42 that distributes the weight of the sleeping individual over springs 32 of the spring assembly 30. Pallet 42 may sometimes include a mesh layer (not shown) which serves to isolate the succeeding layers from spring assembly 30. Otherwise, the first layer is an insulator layer 52 typically made of felt followed by a foam cushion layer 54, which together help distribute the load over the coiled springs 32. Next, there is a fiber layer 56 made of a filler materials. Finally, a quilted layer 58 is applied to the top face 12 and bottom face 14. Insulator layer 52, foam layer 54, filler layer 56 and quilted layer 58 are applied to both top face 12 and bottom face 14. A side panel 60 is sewn to quilted layer 58 to hold it in place on spring assembly 30.

Figure 2:
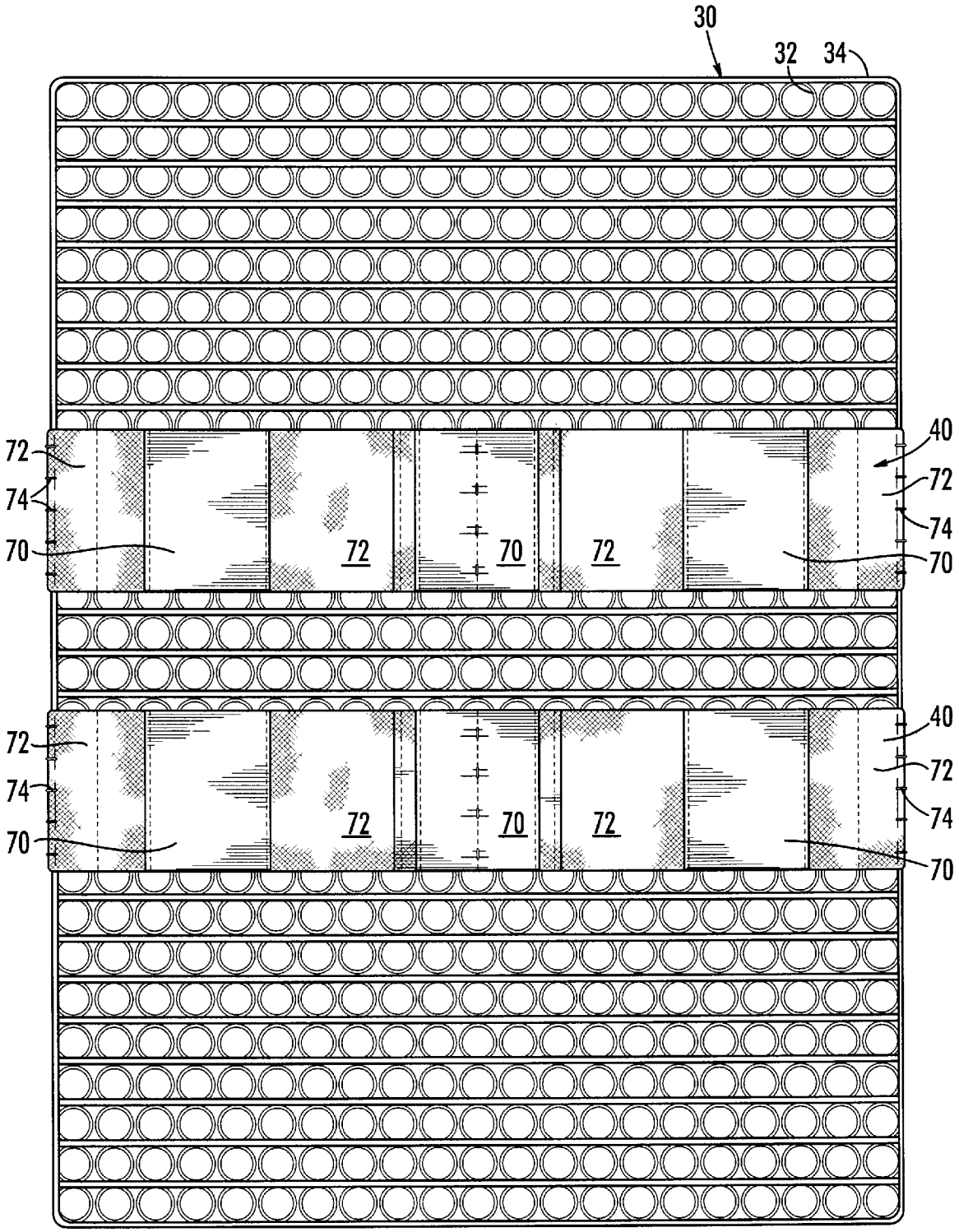
FIG. 2 is a top view of a mattress showing the bands, according to a preferred embodiment of the present invention.
Figure 3A:
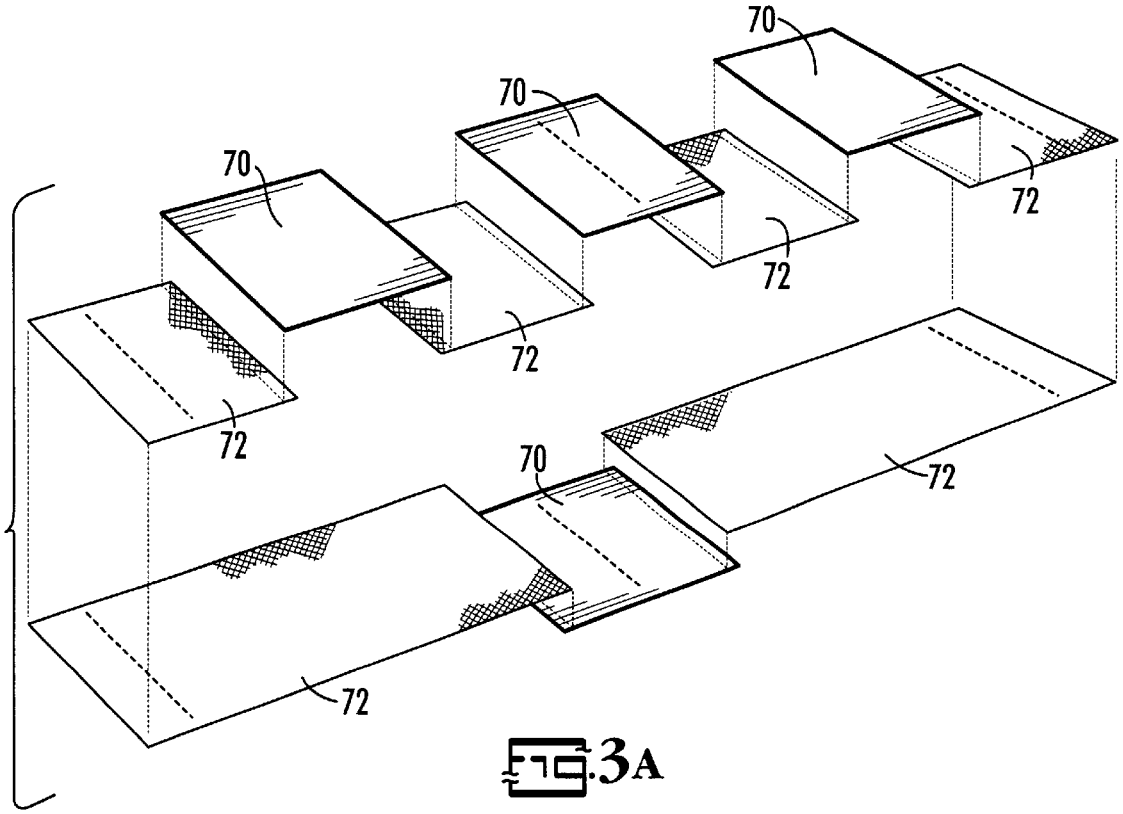
FIGS. 3A and 3B are perspective exploded and assembled views of a band, respectively, according to a preferred embodiment of the present invention.
Figure 3B:
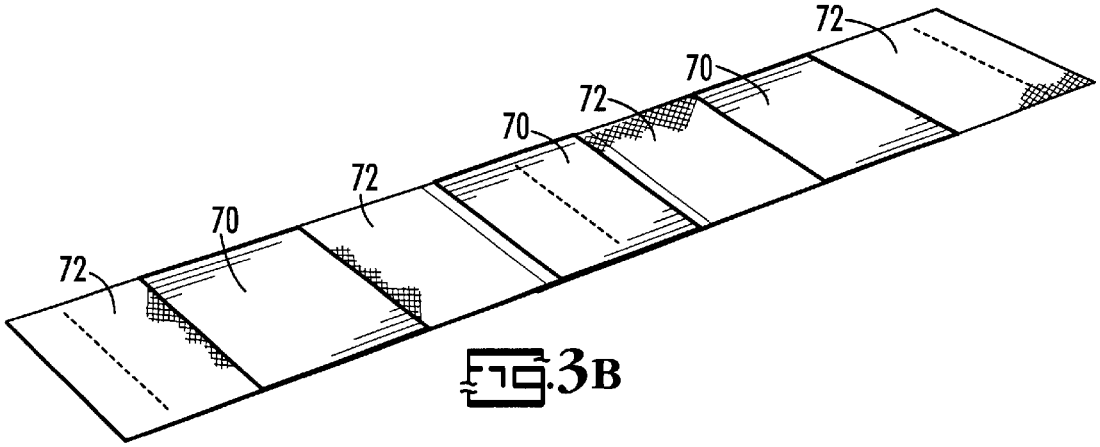

FIG. 2 illustrates the location of bands 40 with respect to mattress 10, namely, where it can expect the greatest load. The portion of a mattress that can be expected to bear the greatest load depends on the type of mattress. Double, queen-size and king-size mattresses are designed to accommodate two sleepers; a twin mattress is designed for one sleeper. The greatest loads would be expected to occur where the shoulders and hips of the sleeper would be positioned on mattress 10. However, it must be remembered that mattresses are turned and rotated, so, preferably, bands 40 should be symmetric with respect to ends 18, 18' and top face 12 and bottom face 14. Bands 40 may also run from end 18 to end 18'. Generally also two bands 40 are sufficient for most mattresses, especially double bed mattresses, queen-size mattresses and king size mattresses. However, for twin bed mattresses, one band, preferably running from end 18 to 18' may be sufficient.

If more than two bands 40 are used, the additional bands 40 need not run in the same direction as the first two bands.

Band 40 is composed of one or more resilient panels 70 alternated with non-resilient panels 72. Resilient panels 70 are attached to non-resilient panels 72 preferably by stitching. Resilient panels 70 are preferably highly resilient and made of material similar to that used in waste bands for garments, which typically consists of rubber or synthetic rubber cords woven into a fabric. This material typically stretches more readily on one direction and much less so in another direction. Therefore, it must be oriented so that it stretches most in a direction parallel to the major direction of the band.

Non-resilient panels 72 may be made of any non-resilient material such as a non-woven plastic or fiberglass fibers pressed into a sheet-like form.

Bands 40 are preferably approximately one foot or more in width and run across top face 12 and bottom face 14 from side 16 to side 16' or end 18 to end 18'. Each band 40 is also preferably a double layer with resilient panels 70 in both layers and arranged so that there is little overlap if any. Each band 40 is fastened by clips 74 to metal frame 34.

Resilient panel 70 are preferably at least the width of a human adult, at least one foot and preferably at least 15 inches. The width of non-resilient panels 72 would be based on the width of resilient panels 70 and the width of mattress 10 generally. Overall, bands 40 cover only a portion of top face 12 and bottom face 14 of mattress 10.

Figure 4A:
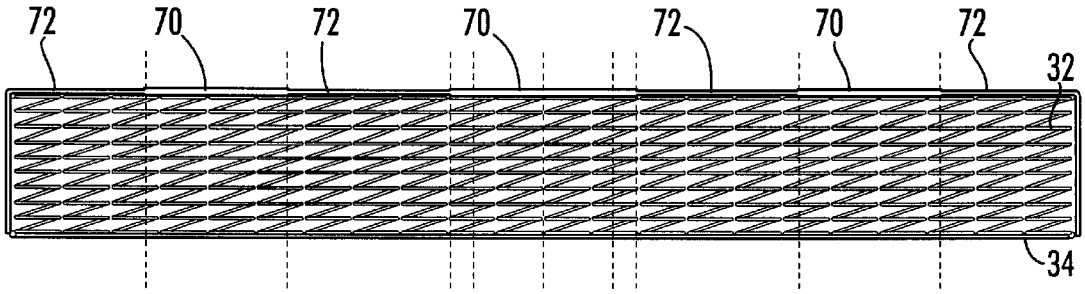
FIGS. 4A and 4B are cross sectional views of a mattress spring assembly with a band thereon without and with loads, respectively, according to a preferred embodiment of the present invention.
Figure 4B:
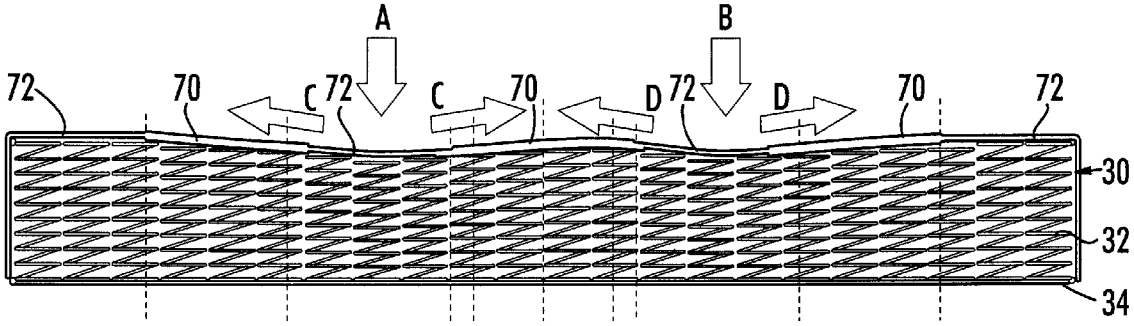

As illustrated by comparison of FIGS. 4A and 4B, when loads A and B are applied to band 40 on spring assembly 30 as indicated by the arrows, tension on resilient panels 70 increases in proportion to the load, as resilient panels 70 stretch. The direction of the tension is as indicated by arrows C and D in a direction generally parallel to the surface of band 40.

It will be apparent to those skilled in mattress construction that many substitutions and modifications can be made to the preferred embodiments just described without departing from the spirit and scope of the present invention, defined by the appended claims.

What is claimed is:

1. A mattress, comprising:

a spring assembly having a face;

a band attached to said spring assembly and running across said face over a portion of said spring assembly, said band being made of a resilient material, wherein said band is formed to have two layers; and a pallet laying over said spring assembly and said band, said pallet being attached to said spring assembly.

2. The mattress as recited in claim 1, wherein said band includes a resilient panel and a non-resilient panel.

3. The mattress as recited in claim 1, wherein said spring assembly has two sides and said band runs from side to side.

4. The mattress as recited in claim 3, wherein said band is positioned on said spring assembly in a location where said mattress is expected to bear the greatest load.

5. The mattress as recited in claim 1, wherein said band has a major dimension and where said resilient material stretches in a direction parallel to said major dimension of said band.

6. The mattress as recited in claim 5, wherein said band includes a resilient panel and a non-resilient panel.

7. The mattress as recited in claim 5, wherein said band is positioned on said spring assembly in a location where said mattress is expected to bear the greatest load.

8. The mattress as recited in claim 1, wherein said spring assembly has two sides and said band has a major dimension, and wherein said major dimension of said band runs from side to side of said spring assembly.

9. The mattress as recited in claim 8, wherein said band is positioned on said spring assembly in a location where said mattress is expected to bear the greatest load.

10. The mattress as recited in claim 1, wherein said band is positioned on said spring assembly in a location where said mattress is expected to bear the greatest load.

11. The mattress as recited in claim 1, wherein said band is attached to said spring assembly with clips.

12. A mattress, comprising:

a spring assembly having a face;

at least one band attached to said spring assembly and running across said face over a portion of said spring assembly, said at least one band having at least one resilient panel and at least one non-resilient panel; and a pallet laying over said spring assembly and said band, said pallet being attached to said spring assembly.

13. The mattress as recited in claim 12, wherein said at least one band is two bands.

14. The mattress as recited in claim 12, wherein said at least one band is positioned on said spring assembly where said mattress is expected to bear the greatest load.

15. The mattress as recited in claim 12, wherein said at least one resilient panel is at least two resilient panels and said at least one non-resilient panel is at least three non-resilient panels.

16. The mattress as recited in claim 12, wherein said at least one resilient panel is sewn to said non-resilient panel.

17. The mattress as recited in claim 12, wherein said spring assembly has two sides and said at least one band has a major dimension, said at least one band being oriented so that said major dimension runs between said sides.

18. A mattress, comprising:

a spring assembly having a face;

two bands attached to said spring assembly and running across said face over a portion of said spring assembly, said two bands being made of panels of a resilient material sewn to panels of a non-resilient material so that said resilient panels are located where said spring assembly is expected to bear the greatest loads; and a pallet laying over said spring assembly and said band, said pallet being attached to said spring assembly.

19. The mattress as recited in claim 18, wherein said bands have a major dimension and wherein said resilient panels stretch more in one direction than in another direction, and wherein said resilient panels are oriented so as to stretch in a direction parallel to said major dimension.

20. The mattress as recited in claim 18, wherein said spring assembly has two sides and wherein said bands include two layers running between said sides.

* * * * *